US005531052A

United States Patent [19]

Agar

[11] Patent Number: 5,531,052

[45] Date of Patent: Jul. 2, 1996

[54] UNITARY SUSPENSION CLIP FOR SUPPORTING PARTITION WALLS

[76] Inventor: Robert S. Agar, 150 Ferrier St., Unit 14, Markham, Ontario, Canada, L3R 3K3

[21] Appl. No.: 174,243

[22] Filed: Dec. 28, 1993

[51] Int. Cl.[6] ..... E04B 2/30

[52] U.S. Cl. ..... 52/489.2; 52/481.2; 52/511; 52/715; 52/745.2; 52/DIG. 6; 411/461; 411/466

[58] Field of Search ..... 52/481.2, 489.1, 52/489.2, 511, 745.2, DIG. 6, 715; 411/461, 462, 463, 464, 465, 466, 467, 468

[56] References Cited

U.S. PATENT DOCUMENTS

| | | |
|---|---|---|
| 1,810,597 | 6/1931 | Corwin . |
| 2,055,442 | 9/1936 | Jones . |
| 2,097,988 | 11/1937 | Ross et al. . |
| 2,101,001 | 11/1937 | Balduf . |
| 2,277,758 | 3/1942 | Hawkins . |
| 2,293,862 | 8/1942 | Sorenson . |
| 2,325,766 | 8/1943 | Gisondi . |
| 2,396,030 | 3/1946 | Terry . |
| 3,127,145 | 3/1964 | McGinty et al. . |
| 3,286,412 | 11/1966 | Greig et al. . |
| 3,295,405 | 1/1967 | Burke . |
| 3,300,924 | 1/1967 | Ashby et al. . |
| 3,312,030 | 4/1967 | Gillespie . |
| 3,416,821 | 12/1968 | Benno . |
| 3,460,302 | 8/1969 | Cooper . |
| 3,731,447 | 5/1973 | Dawdy et al. . |
| 3,842,554 | 10/1974 | Swick . |
| 3,906,695 | 9/1975 | Pilgrim et al. . |
| 3,948,011 | 4/1976 | Price et al. . |
| 3,950,904 | 4/1976 | Littman . |
| 4,128,979 | 12/1978 | Price . |
| 4,245,448 | 1/1981 | Agar . |
| 4,394,808 | 7/1983 | Thorsell . |

(List continued on next page.)

FOREIGN PATENT DOCUMENTS

| | | |
|---|---|---|
| 1044870 | 12/1978 | Canada . |
| 1314682 | 3/1993 | Canada . |
| 692084 | 5/1953 | United Kingdom . |
| 1120632 | 7/1968 | United Kingdom . |
| 1600887 | 10/1981 | United Kingdom . |
| WO83/02635 | 8/1983 | WIPO . |
| WO89/02502 | 3/1989 | WIPO . |
| WO91/14057 | 9/1991 | WIPO . |

OTHER PUBLICATIONS

Partition Systems (MFG) Ltd., PS 350 Movable Partition System 8–page brochure (date unknown by Applicant's copy bears U.S. Patent Office Mail Room stamp dated Feb. 18, 1975).

Gravity Lock Wall Systems, Canada, PC 350, 8–page brochure (date unknown).

Gravity Lock Wall Systems, Canada, PC 350, 8–page brochure (date unknown).

*Primary Examiner*—Carl D. Friedman
*Assistant Examiner*—Kevin D. Wilkens
*Attorney, Agent, or Firm*—Mark R. Wisner

[57] ABSTRACT

A unitary suspension clip for suspending gypsum board panels from the horizontal channel member of an erect support structure. The plate portion of the clip has panel-piercing members projecting rearwardly to affix the plate to the panel. A transverse line of weakness extends substantially across the width of the plate such that when the panel is suspended from the channel member, the load applied between the channel member and the plate causes the plate to bend therealong to prevent the pulling of the panel-piercing members out of the panel. A wing is formed along the edge of the plate and extends outwardly therefrom with a second line of weakness running in the same direction as the edge of the plate between the wing and the plate. The wing is bent at the second line of weakness upwardly from the surface of the gypsum board panel and has an angled surface formed therein which rests on the horizontal channel member and causes the panel to be drawn into engagement with the erect support structure.

9 Claims, 2 Drawing Sheets

U.S. PATENT DOCUMENTS 4,448,004 5/1984 Thorsell .
4,566,241 1/1986 Schneller .
4,693,047 9/1987 Menchetti .
4,704,835 11/1987 Jordan ..... 52/489.1
4,719,730 1/1988 Winkowski .
4,811,539 3/1989 Menchetti .
5,060,434 10/1991 Allison .
5,216,859 6/1993 Moreno et al. .

UNITARY SUSPENSION CLIP FOR SUPPORTING PARTITION WALLS

BACKGROUND OF THE INVENTION

So-called "demountable " interior partition wall systems have been available from Partition Components, Inc. (Markham, Ontario) and the Gold Bond Building Products Division of National Gypsum Company (the Gold Bond line is now available from Gravity Lock Systems, Inc., Houston, Tex.) since at least the issuance of U.S. Pat. Nos. 3,948,011 (in 1976) and 4,128,979 (in 1978), and their Canadian counterparts. Although these wall systems have been improved over the years to the point that their installation has been greatly simplified (indeed, although other tools are useful, the only tool needed for their installation is a rubber mallet), efforts are still underway to improve their cost advantages.

The above-mentioned U.S. Pat. No. 4,128,979 describes a so-called "suspension clip " which has proved to be the single most important component of a demountable wall system, and it is this component which, in spite of the ease of installation, occupies most of the installer's time as the partition wall is being erected. Consequently, significant time (and cost) savings could be realized if a clip was available which would simplify installation of a demountable wall system even further, and it is to this problem that the present invention is addressed.

One way to simplify installation of systems utilizing such suspension clips would be to improve the clips by making them unitary instead of making them from two pieces. Such slips are first disclosed in the afore-mentioned U.S. Pat. No. 3,948,011, and went through evolutionary changes as shown in U.S. Pat. Nos. 4,128,979 and 4,245,448, the latter issuing in 1981 and showing the clip in the embodiment which is being sold even to this date. However, all such clips require the assembly of two pieces; even more recent patents issued to entities and/or persons other than the originators of these clips and directed to other aspects of the walls erected using these clips such as U.S. Pat. Nos. 4,693,047 and 4,811,539, issued to National Gypsum Company in 1987 and 1989, respectively, show the clip as a two-piece assembly.

The only disclosure of a single piece suspension clip of which Applicant is aware appears in U.S. Pat. Nos. 5,060,434 (also shown in somewhat modified form in U.S. Pat. No. 5,216,859, a continuation-in-part of U.S. Pat. No. 5,060,434), licensed to Gravity Lock Systems, Inc., and a published PCT application, No. WO-83/02635. For a variety of reasons, the clip shown in U.S. Pat. No. 5,060,434 is of limited utility, but the clip shown in WO-83/02635 is so much closer in structure to the clip of the present invention that only the disadvantages and limitations of the latter are addressed here.

The most significant disadvantage of the clip shown in WO-83/02635 stems from the intention that the clip be used in a so-called "edge grip " system. In other words, as shown in FIGS. 1 and 2 of that published application, when the clip is affixed to a gypsum board, it is positioned near the edge of the gypsum board. Each clip is provided with a lateral extension 12 on the opposed long edges of a central plate 9, and as shown in FIG. 2, if the clip is affixed at the left edge of a gypsum board panel, the left-hand extension 12 is bent at approximately a 90° angle away from the panel and is received in a slot (not separately numbered in the figures) in the face of the vertical studs which support the panel as shown in FIG. 4. This structure does not allow the gypsum board panel to be moved laterally into abutment with an adjacent panel, which is an important advantage of the system shown in the above-referenced U.S. Pat. Nos. 3,948,011, 4,128,979, and 4,245,448, which greatly facilitates the erection of the wall.

More important, however, is the cut 14 (best shown in FIGS. 5 and 8) formed in the clip shown in WO-83/02635. The clip shown in the three referenced U.S. patents effectively functions to draw a gypsum board panel tight against the studs because of the action of the weight of the panel on the angled portion of the clip which engages the horizontal support members mounted to the vertical studs, resulting in adjacent panels which are not only flush with each other but which are effectively retained in that flush relationship by the downward force on the panels The cut 14 in the clip shown in WO-83/02635, however, rests on the edge of the slot formed in the studs and the panel to which that clip is affixed is not affirmatively and tightly held against the studs. The edge of the lateral extension 12 of the clip shown in WO-83/02635 does include an angled portion (shown at reference numeral 17), but that angled portion appears to function only as an aid to the insertion of the lateral extension 12 into the slots in the studs. That clip is, therefore, limited in utility in the sense that to obtain a wall with the smooth, flat surface which is easily obtained with the clip used in the system shown in the three referenced U.S. patents requires that the installer spend extra time installing the wall, so as to minimize variation from one panel to another, and then taping and floating the joints between panels. It is, therefore, a principal object of the present invention to provide a unitary suspension clip for mounting a gypsum board panel to a vertical framework which retains the advantages of this "camming " action of the two-piece suspension clip shown in U.S. Pat. Nos. 4,128,979 and 4,245,448 which results in the drawing of adjacent panels into flush relationship and then firmly holds the panels flush with each other.

It is also an object of the present invention to provide a suspension clip which allows a partition wall of the type shown in U.S. Pat. Nos. 3,948,011, 4,128,979, and 4,245,448 to be assembled more quickly.

Another object of the present invention is to provide a suspension clip which can be affixed to a gypsum board panel at a location remote from the site of the wall into which the panel is being assembled.

Other objects, and the advantages, of the present invention will be made clear to those skilled in the art by the following description of a presently preferred embodiment thereof.

SUMMARY OF THE INVENTION

These objects are achieved by providing a one piece, or unitary, suspension clip for demountably supporting a gypsum board panel on the horizontal channel member of an erect support structure. In one embodiment, the clip comprises a substantially rectangular plate formed of upper and lower portions having a plurality of panel-piercing members extending from one face thereof and a transverse line of weakness extending substantially across the plate between the upper and lower portions. A wing, or outwardly extending projection, is formed in the plate along the edge thereof and an angled surface is formed on the wing. A second line of weakness extends along the edge of the plate between the wing and the plate so that the wing can be pivoted from a first position in which the surface of the wing is substantially co-planar with the surface of the plate when the plate is formed to a second position in which the surface of the wing forms an angle relative to the surface of the plate to allow the angled surface formed in the wing to rest on the horizontal channel member of an erect support structure, thereby supporting a gypsum board panel to which the panel-piercing members of the plate are engaged on the support structure, the angled surface of the wing and the weight of the gypsum board panel cooperating to draw the gypsum board panel tight against the erect support structure.

In another embodiment, the present invention is a method of erecting a demountable partition wall comprising the steps of erecting a vertical support structure including a horizontal channel member, affixing a suspension clip comprised of a plate having a plurality of panel piercing members extending from one face thereof to a gypsum board panel by pushing the panel piercing member,s into the panel, and pivoting a wing which forms a portion of the plate from a first position substantially co-planar with the plate and the gypsum board panel to which the plate is affixed to a second position angled upwardly, away from, the surface of the gypsum board panel. The gypsum board panel having the suspension clip affixed thereto is then supported on the support structure by resting the angled surface formed in the wing over the horizontal channel member after the wing is bent to the second position, the angled surface and the weight of the gypsum board panel cooperating to draw the gypsum board panel tight against the support structure.

DETAILED DESCRIPTION OF THE INVENTION

Figure 1:
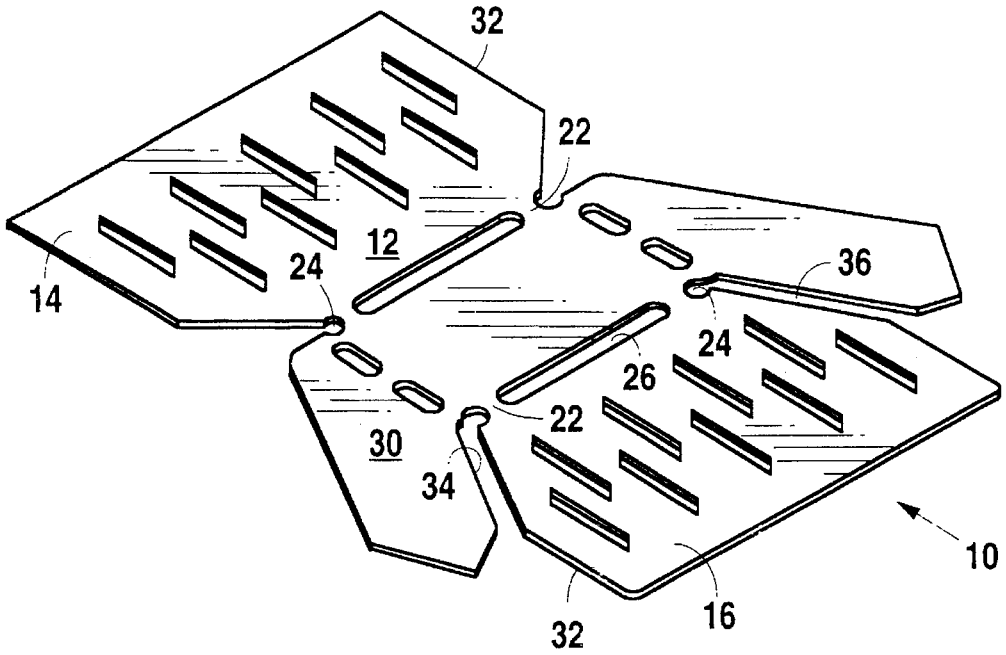
FIG. 1 is a perspective view of a preferred embodiment of a suspension clip constructed in accordance with the present invention.

Referring now to the figures, a presently preferred embodiment of the suspension clip of the present invention is indicated generally at reference numeral 10. The clip 10 is comprised of a generally rectangularly-shaped gang nail plate 12 having upper 14 and lower 16 portions with panel-piercing members 18 extending from one face 20 thereof. In a particularly preferred embodiment, the clip 10 is stamped from a piece of 23 gage or higher, preferably galvanized, steel having a Rockwell hardness "B " 40–60 and a tensile strength of 45,000–55,000 p.s.i. These standards are specified so that the members 18 do not break when driven into a gypsum board panel (not shown). The die utilized to press the clip 10 from the piece of metal preferably introduces a twist into each of the panel piercing members 18 of about 60° (from straight) as they are punched out from the metal, but as is the case for each of the numerical specifications set out herein, that degree of twist is set out for purposes of exemplification, not limitation. Indeed, the twist of the members 18 functions to increase the "grip " of the clip 10 to a gypsum board panel, and this enhancement can be accomplished with a twist of some (instead of all) of the panel piercing members and/or with a twist of as little of 5°–10° from straight.

A transverse line of weakness, indicated generally at reference numeral 22, extends substantially across the plate 12 between the upper and lower portions 14 and 16, respectively, thereof. The line of weakness, as taught by U.S. Pat. Nos. 4,128,979 and 4,245,448 is formed of a combination of aligned, inwardly extending notches 24 and/or slots 26 cut in plate 12 about which plate 12 bends to improve anchorage of the clip 10 to a gypsum board panel 28 (see FIGS. 4 and 5) under applied loads as more completely described in those two patents, the disclosure of both patents being incorporated herein in its entirety by this specific reference thereto.

Figure 2:
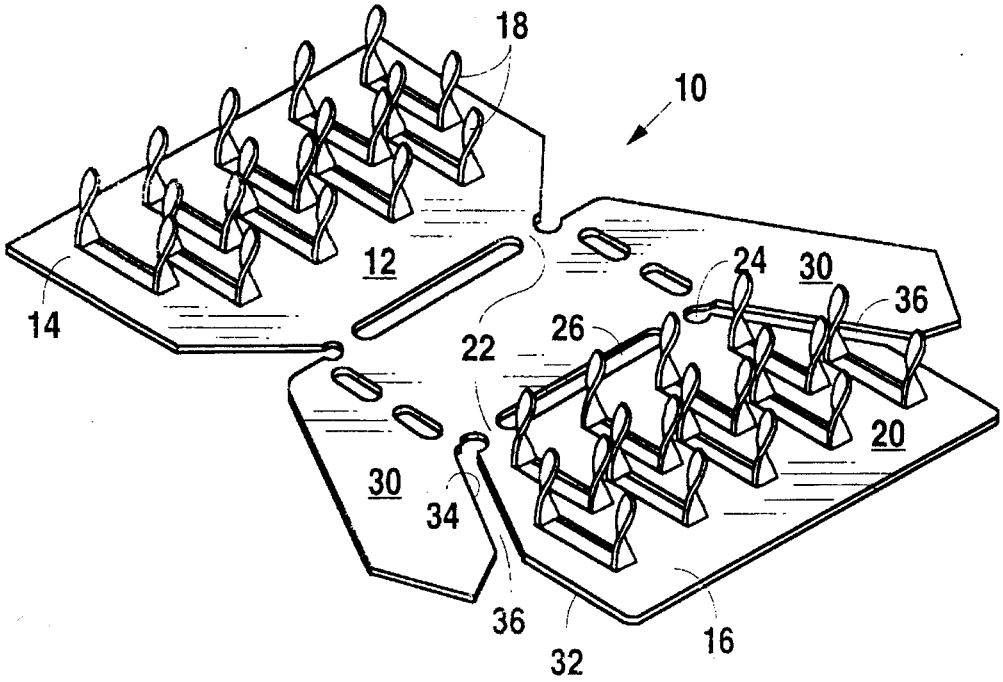
FIG. 2 is a perspective view of the opposite side of the suspension clip of FIG. 1.

As best shown in FIGS. 1 and 2, a wing 30 is formed in plate 12 along the edge 32 thereof, e.g., along the long side of the rectangularly-shaped plate 12, and extends outwardly from edge 32. One surface 34 of wing 30 is angled relative to the long edge 32 of plate 12 and is formed by the channel 36 which extends inwardly from the edge 32 of the plate 12. Channel 36 is formed at an acute angle relative to the edge 32 of plate 12 and extends inwardly therefrom to terminate at a point spaced inwardly from the edge 32 of the plate, thereby forming a part of the line of weakness 22.

A second line of weakness is formed in the plate 12 along the long edge 32 thereof by the slots 38 cut in plate 12 from a point near the notch 24 at the inside end of the channel 36, in a direction substantially co-linear with the edge 32 of the plate 12, to a point adjacent the notch 24 formed in the same edge 32 of plate 12 on the side of wing 30 opposite channel 36. The second line of weakness formed by the slots 38 between plate 12 and wing 30 weakens the plate 12 so that the wing 30, which comprises the portion of plate 12 outside that line of weakness, is easily pivoted by bending from a first position (shown in FIGS. 1 and 2) in which the surface of wing 30 is substantially co-planar with the surface of plate 12 to a second position (shown in FIGS. 3 and 5) in which the surface of wing 30 forms an angle relative to the surface of plate 12.

Figure 5:
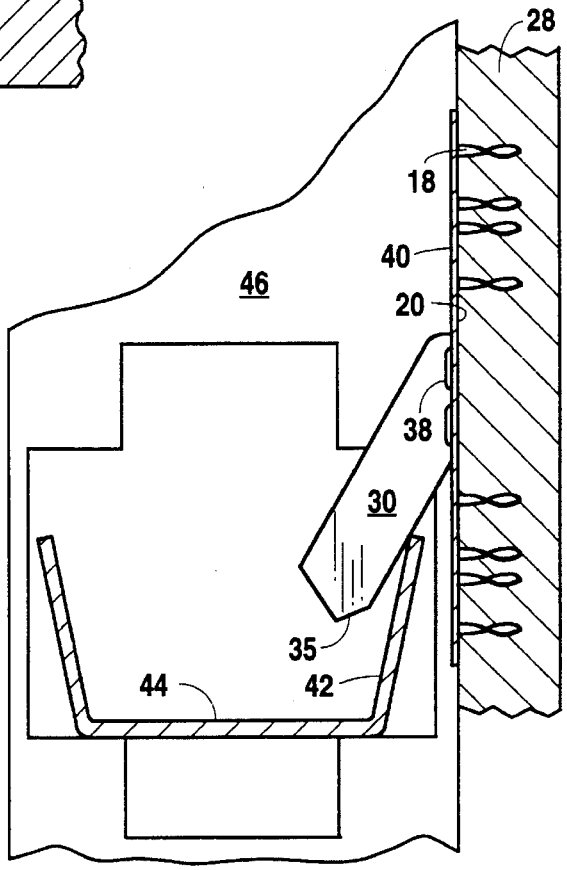
FIG. 5 is a longitudinal-sectional view of the suspension clip of FIG. 1, after affixation of the clip to a gypsum board panel and the bending of the wings to the second position, showing the manner in which the wings engage the channel member of a vertical support structure.

When in this second position, the wing 30 extends from plate 12 in a direction opposite the direction of the panel-piercing members 18 and from the face 40 opposite the face 20. In this manner, the angled surface 34 of wing 30 and the face 40 of plate 12 form an inverted "V ", best shown in FIG. 5, for receiving the edge 42 of the horizontal channel member 44 of a previously-erected vertical support structure, only a portion of one of the studs 46 and the channel member 44 of which are shown in FIG. 5 for purposes of clarity. As used herein, the phrase "vertical support structure" refers to the wall studs and horizontal support, or channel, members described in the above-incorporated U.S. Pat. Nos. 4,128,979 and 4,245,448, and/or patents such as the above-referenced U.S. Pat. Nos. 5,060,434, 4,693,047, and 4,837,988. The wing 30, resting on the angled edge 42 of channel member 44, thereby supports the gypsum board panel 28 to which the panel-piercing members 18 of plate 12 are engaged on the vertical support structure. Note that the angled edge 42 is not shown extending all the way to the top of the inverted "V" formed by the angled surface 34 of wing 30 and the face 40 of plate 12; instead, as shown in FIG. 5, the angled surface 34 of wing 30 functions to pull the gypsum board panel 28 tight against the face of the stud 46 because the weight of the gypsum board panel 28 causes the edge 42 of channel member 44 to slide along the angled surface 34 up towards the face 40 of plate 12, effectively camming the gypsum board panel 28 into alignment with any adjacent such panels (not shown).

Figure 4:
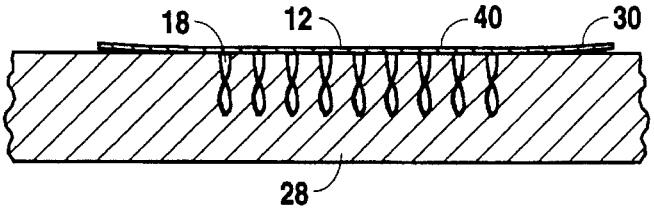
FIG. 4 is a cross-sectional view of the suspension clip of FIG. 1 after the clip has been affixed to a gypsum board panel.

Because one object of the clip 10 is to improve the economics of its use, in one preferred embodiment in which economies are maximized, the gypsum board panel 28 is shipped to a job site with the clip 10 already affixed thereto. The single piece, or unitary, construction of clip 10 (as compared to the two-piece construction of the clip described in the above-incorporated patents), as well as its essentially flat profile as shown in FIG. 4, makes it possible to affix a plurality of the clips 10 to a gypsum board panel 28 (preferably with automated equipment) at a location other than the location of the vertical support structure to which the panel is to be mounted and then stack another such panel (not shown) on top of the panel 28 so that a stack of several such panels can be shipped to the location at which they are to be erected into a partition.

Figure 3:
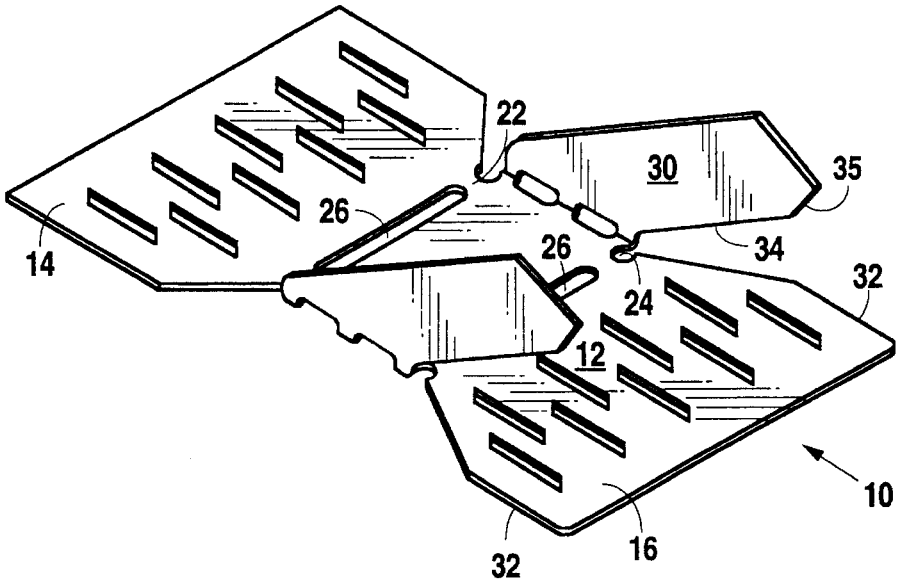
FIG. 3 is a perspective view of the suspension clip of FIG. 1 after the wings comprising a portion of the clip have been bent from a first position upwardly to a second position.

In a particularly economical embodiment, also made possible by the unitary construction of the clip 10, the wings 30 are angled upwardly from the surface of the gypsum board panel 28 at a slight angle to facilitate their bending along the second line of weakness formed by the slots 38 to the second position shown in FIGS. 3 and 5,, This slight bend from the first position of wings 30 toward the second position is accomplished at the time the clip 10 is stamped or when the clip 10 is affixed to the gypsum board panel 28. If the latter, the bend can be accomplished in a number of ways. Depending upon how weak the line of weakness formed along the edge 32 of plate 12 by slots 38 is, the slight upward bend results from the driving of the panel-piercing members 18 into the panel 28, e.g., if the plate 12 is considerably weakened and affixed to panel 28 by application of substantial pressure on the portion of the face 40 of plate 12 other than wings 30, the gypsum board panel 28 under plate 12 is compressed enough that the uncompressed portion of the panel 28 causes the wings 30 to bend upwardly therefrom. That upward bending can also be accomplished by interposing a thin piece of metal (not shown) or other material between the wing 30 and panel 28 (but not between the face 20 of plate 12 and panel 28) when the clip 10 is affixed to the gypsum board panel 28.

Having described a preferred embodiment of the unitary suspension clip of the present invention, a method of erecting a demountable partition wall utilizing that clip will now be described. After erection of a vertical support structure including a horizontal channel member such as the channel 44, the suspension clip 10, comprised of a plate 12 having a plurality of panel-piercing members 18 extending from one face 20 thereof, is affixed to a gypsum board panel 28 by pushing or driving the panel-piercing members 18 into the panel 28. A wing 30 formed in the plate 12 is pivoted from a first position substantially co-planar with plate 12 to a second position angled upwardly from the surface of the gypsum board panel The gypsum board panel 28, having the suspension clip 10 affixed thereto, is then supported on the horizontal channel member 44 of the vertical support structure by resting the angled surface 34 of the wing 30 formed in the plate 12 over the edge 42 of channel member 44 when the wing 30 is in the second position. The weight of the panel 28 causes the clip 10 and panel 28 to slide downwardly relative to the channel member 42 so that the angled surface 34 slides along the edge 42 of channel member 44, thereby translating the downward movement of the panel 28 into movement having an inward component which draws the panel 28 tight against the studs 46 supporting the channel member 44 and preventing movement of panel 28 away from the studs 46. In a particularly preferred embodiment of the method of the present invention, the wing 30 is bent slightly upwardly from the surface of the gypsum board panel 28 so as to facilitate the bending of the wing to the second position immediately before the wing 30 is assembled to the channel 44.

Although described and illustrated in terms of certain presently preferred embodiments, those skilled in the art who have the benefit of this disclosure will recognize that certain changes and/or modifications can and may be made to the manner in which the component parts thereof function to achieve their intended result. For instance, the wings 30 are formed at the edge 32 of plate 12 as a matter of convenience resulting from the stamping of the clip 10 from a single piece of metal. The wings can also be formed in the central portion of plate 12 to pivot outwardly and upwardly, in a manner analogous to the opening of the shutters over a window. Likewise, the slots 26 forming the transverse line of weakness can be omitted in favor of notches 24 cut further in from the edge 32 of plate 12 towards the center thereof than shown in the figures to form a narrow "throat " about which the plate 12 bends. All such modifications are intended to fall within the spirit and scope of the present invention as defined by the following claims.

What is claimed is:

1. A unitary suspension clip for supporting a gypsum board panel on a horizontal channel member comprising a vertical support structure comprising:

a plate comprised of upper and lower portions having a plurality of panel piercing members for affixing said plate to a gypsum board panel extending from one face thereof;

a transverse line of weakness extending substantially across said plate between the upper and lower portions thereof;

a channel formed in said plate at an acute angle relative to the edge of said plate and terminating at a point spaced inwardly from the edge of said plate;

a second line of weakness formed in said plate and extending from a point near the termination of said channel in a direction substantially co-linear with the edge of said plate; and a wing formed integrally with said plate and extending outwardly from the edge thereof pivotable about said second line weakness from a first position substantially co-planar with said plate to a second position forming an angle relative to said plate whereby the edge of said wing formed by said channel comprises a surface angled at an acute angle relative to the edge of said plate for cooperating with the horizontal channel member of the vertical support structure to translate the downward movement of the clip resulting from the weight of the panel to which the clip is engaged into movement which draws the panel into engagement with the vertical support structure and prevents movement of the panel away from the vertical support structure.

2. The unitary suspension clip of claim 1 wherein said plate is substantially rectangularly-shaped, both of the edges of said plate being provided with lines of weakness and wings along the long dimension thereof.

3. A gypsum board panel having a plurality of the unitary suspension clips of claim 1 affixed thereto.

4. A demountable partition wall having a plurality of the gypsum board panels of claim 3 supported thereon.

5. A method of erecting a demountable partition wall comprising the steps of:

erecting a vertical support structure including a horizontal channel member; affixing a suspension clip comprised of a plate having a plurality of panel piercing members extending from one face thereof to a gypsum board panel by driving the panel piercing members into the gypsum board panel;

pivoting a wing formed at the edge of the plate and having a surface forming an acute angle relative to the edge of the plate formed thereon from a first position substantially co-planar with the plate to a second position angled upwardly from the surface of the gypsum board panel;

supporting the gypsum board panel having the suspension clip affixed thereto from the horizontal channel member of the support structure by resting the angled surface formed on the edge of the wing on the plate over the channel member when the wing is in the second position; and drawing the gypsum board panel having the suspension clip affixed thereto into engagement with the vertical support structure during downward movement of the suspension clip relative to the channel member resulting from the interaction of the weight of the gypsum board panel, the angled surface on the edge of the wing, and the horizontal channel.

6. The method of claim 5 wherein the wing is pivoted from first to second positions by bending along a line of weakness formed in the plate, 7. The method of claim 6 wherein the wing is bent upwardly from the surface of the gypsum board panel when applied thereto at a small angle to facilitate the bending of the wing to the second position immediately before the wing is rested on the horizontal channel member.

8. The method of claim 5 wherein the suspension clip is affixed to the gypsum board panel at a location other than the location of the vertical support structure and the wing is pivoted from first position to second position at the location of the vertical support structure, 9. The method of claim 8 additionally comprising stacking more than one of the gypsum board panels to which a suspension clip is affixed.

* * * * *